US006656062B2

(12) United States Patent
Vochezer

(10) Patent No.: US 6,656,062 B2
(45) Date of Patent: Dec. 2, 2003

(54) DIVOT TOOL

(75) Inventor: Georg Vochezer, Argenbuehl (DE)

(73) Assignee: Rudolf Wittner GmbH u. Co., Isny (DE)

( * ) Notice: Subject to any disclaimer, the term of this patent is extended or adjusted under 35 U.S.C. 154(b) by 1 day.

(21) Appl. No.: 10/023,588

(22) Filed: Dec. 18, 2001

(65) Prior Publication Data

US 2002/0082123 A1 Jun. 27, 2002

(30) Foreign Application Priority Data

Dec. 21, 2000 (DE) ..... 100 63 890

(51) Int. Cl.[7] ..... A63B 57/00
(52) U.S. Cl. ..... 473/408
(58) Field of Search ..... 473/285, 286, 473/406, 408; D21/793, 794

(56) References Cited

U.S. PATENT DOCUMENTS 3,977,674 A * 8/1976 Zeller ..... 473/285
4,627,621 A 12/1986 Tate
4,960,239 A 10/1990 Wait
5,054,777 A * 10/1991 Borden et al. ..... 473/406
5,110,123 A * 5/1992 Larson ..... 473/406
5,116,046 A 5/1992 Pace
5,160,134 A * 11/1992 McDonald ..... 473/406
5,224,700 A * 7/1993 Rosen ..... 473/408
5,292,120 A * 3/1994 Pehoski et al. ..... 473/286
5,305,999 A 4/1994 Tate
5,759,120 A 6/1998 Mathis et al.
5,769,740 A * 6/1998 Colangelo ..... 473/408
6,030,298 A * 2/2000 Tate ..... 473/408

* cited by examiner

*Primary Examiner*—Steven Wong
(74) *Attorney, Agent, or Firm*—Barry R. Lipsitz; Douglas M. McAllister

(57) ABSTRACT

It is proposed that a divot tool comprising a handle part and a fork part be constructed as a divot tuning fork whereby the fork part is in the form of a tuning fork which vibrates at a defined frequency, and in that the construction of the handle part and the arrangement of the fork part on a handle part be such that the handle part does not substantially affect the frequency of vibration of the fork part.

28 Claims, 4 Drawing Sheets

DIVOT TOOL

The present disclosure relates to the subject matter disclosed in German application No. 100 63 890.2 of Dec. 21, 2000, which is incorporated herein by reference in its entirety and for all purposes.

BACKGROUND OF THE INVENTION

The invention relates to a divot tool comprising a handle part and a fork part.

Divot tools of this type are used for repairing the turf when clumps of grass (divots) have been knocked out whilst hitting balls during games of golf.

Divot tools, which are also referred to as pitch-repair forks, are known from U.S. Pat. Nos. 4,627,621, US 4,960,239, US 5,116,046 and US 5,305,999 for example.

SUMMARY OF THE INVENTION

In accordance with the invention, there is provided a divot tool comprising a handle part and a fork part wherein the fork part is a tuning fork which vibrates at a defined frequency, and wherein the construction of the handle part and the arrangement of the fork part on the handle part are such that the handle part does not substantially affect the frequency of vibration of the fork part.

Thus, in accordance with the invention, a divot tool is adapted as a divot tuning fork. The tuning fork vibrates at a defined frequency, in particular, at the frequency of a fundamental note, and the frequency of vibration itself is not affected by the handle part. The divot tuning fork in accordance with the invention can thereby carry out all of the functions which a divot tool can execute, i.e. especially the repair of the turf by replacement of the divots.

In order to obtain a defined frequency of vibration, it is expedient if the fork part is constructed in one-piece form. The fork part is then dimensioned such that it will exhibit the desired resonant frequency. This one frequency is substantially unaffected by the handle part.

In order to obtain a defined frequency of vibration and in order to produce a vibration whose amplitude decays as slowly as possible, it is especially advantageous if the fork part is made from a metallic material. One possible material is brass for example.

In order to have as little affect upon the vibration of the fork part as possible, it is advantageous if the handle part is made from a non-metallic material. Possible materials are synthetic materials such as wood cement. However, natural wood could also come into question.

In order to construct the fork part in the form of a tuning fork, it is advantageous for the fork part to comprise a first fork prong and a second fork prong which are connected by means of a fork arch. The Eigen frequency of such a structure can be calculated in a simple matter and the frequency can be set in a defined manner by suitable shaping.

Basically, the fork part may be made from a round wire. It is expedient, if the fork part comprises opposite flat surfaces. For equal masses of the fork part, this thereby makes it possible, in particular, for the fork prongs to be widened and for the fork part itself to be shortened (the resonant frequency is a function of the mass) so as to keep the linear extent of the divot tool low. Broad fork prongs are advantageous in regard to the employment thereof as a divot tool i.e. for sticking and digging it into the turf or into a clump of grass. It is especially advantageous, if the width of a fork prong amounts to at least three millimeters.

In order to retain the fork part on the handle part on the one hand, and in order to keep the effect of the handle part on the Eigen frequencies of the fork part as small as possible on the other, it is advantageous that an attachment part for the handle part be arranged on the fork part. The attachment part then serves for mounting the handle part and, by appropriate design of the attachment part, such as the connection thereof to the fork part via a bridge, the effect of the handle part can be minimized.

For example, the attachment part may be arranged at a vertex of a fork arch of the fork part. It is thereby ensured that the effect of the handle part on the Eigen frequencies of the fork part is minimized (and, because of the symmetry of the fork part, this effect equally applies to the fork prongs which are the essential vibrating elements).

In one embodiment, the attachment part is arranged between the fork prongs of the fork part. An especially compact and aesthetically beautiful design for the divot tuning fork can thereby be achieved since the attachment part can be hidden.

However provision may also be made for the attachment part to be arranged outside an intermediary space between the fork prongs of the fork part. This is particularly advantageous when the frequency should be set such that a greater mass will vibrate.

It is expedient if the handle part is clamped to the attachment part. This thereby caters for an adequate fixture between the handle part and the attachment part whereby the contact surfaces between the handle part and the fork part are adapted to be minimized.

In one variant of an embodiment, the attachment part comprises an accomodation like a recess for one or more engaging elements which are arranged on the handle part. A clamp-like retention of the fork part on the handle part can be implemented in this manner. It is especially very advantageous if one engaging element of the handle part is a bar-like member. The contact surface between the fork part and the handle part can thereby again be minimized; basically, the larger the contact surface, the greater the damping effect of the handle part on the vibrations of the fork part could then be.

Furthermore, it is expedient if a bar-like engaging element is arranged substantially parallel to a tangent to the vertex of the fork part so as to enable a shaping of the fork part which is such that it will vibrate at a defined frequency on the one hand, and to cater for an adequate fixture on the other.

In order to minimize the effect of the handle part on the Eigen vibration of the fork part and especially in order to minimize the damping effect of the handle part, it is particularly advantageous if, in regard to the fork prongs, the fork part is held freely on the handle part. Contact between the vibrating fork prongs and the handle part is thereby generally prevented; such contact would lead to a damping of the vibrations. Moreover, if the contact surfaces are rigid then this can produce a substantial change in the frequency of vibration.

In order to ensure freedom between the fork part and the handle part, it is particularly advantageous if an adhesive layer is provided between the fork part and the handle part. The material of the adhesive layer should then be selected such that the transfer of vibrations (and thus the damping of the vibrations) between the fork part and the handle part will be minimized but, on the other hand, that the Eigen vibrations of the fork part will be disturbed as little as possible by the adhesive layer.

In one embodiment, the handle part is constructed in two sections, having one handle element and a second handle element between which the fork part is arranged. From a design point of view, an appealing divot tuning fork can thereby be constructed in a simple manner, one which is compact and which can be manufactured (and assembled) in a simple manner. The handle part, which may be manufactured by an injection molding process for example, can then be produced with the desired shape.

It is expedient if the first handle element comprises a plurality of spaced engaging elements so as to produce a mounting arrangement for fixing it on the fork part. Furthermore, it is expedient if the second handle element comprises one or more engaging elements which are adapted to be positioned in the intermediary space between the engaging elements of the first handle element. On the one hand, the contact surface with the fork part is thereby minimized, whilst, on the other hand, provision is made for adequate retention especially as the two handle elements are also fixed to one another.

In another advantageous variant of an embodiment, the handle part comprises a recessed insert area for a marker. Such markers may carry logos of a golf course for example. By virtue of this insert area, the divot tuning fork in accordance with the invention could then be used as a promotional article, whereby the manufacture thereof is economical since a special "printing" can be effected simply by inserting a marker. Such a marker can also be used as a ball marker on a golf course insofar as it is extractable from the insert area.

To this end, it is expedient if the insert area comprises a depression which is constructed in such a manner that an inserted marker is tiltable with respect to the depression for the purposes of removing it. Especially in that case where the marker is matched relatively precisely to the dimensions of the insert area, it can be difficult to remove it again. By virtue of the depression, it is sufficient to exert a light pressure and thereby tip the marker into the depression whereby it can easily be extracted. This then also enables such a marker to be employed as a ball marker.

In one variant of an embodiment, the insert area is provided with a magnet for holding the marker magnetically. In an alternative embodiment, the marker is held in the insert area by means of a clamping force. Any form of marker can thereby be fixed, especially markers made from a non-magnetic material.

In order to ensure proper retention and easy removeability of the marker when it is retained in the insert area by means of a clamping force, it is advantageous if a snap action connector is arranged on the handle part for holding the marker. By virtue of the snap-in behavior of the snap action connector, it is automatically ensured that the marker will be properly retained and, by virtue of this construction in the form of a snap action connector, this connector can also be opened in order to enable the marker to be extracted.

In one advantageous variant of an embodiment, a support saddle is arranged on the handle part at the end thereof remote from the fork prongs. When the fork prongs of the divot tuning fork in accordance with the invention are stuck into the ground, this support saddle will then enable the grip of a golf club to be placed upon the support saddle. This club grip will thereby be spaced from the possibly damp ground and will remain dry. The support saddle can also be used as a place for resting a cigarette for example.

If a club grip is placed on the support saddle, then the picking up of the club is simplified since the club grip is resting on the ground. For such a use, it is especially advantageous if the support saddle is spaced from the handle part by one or more leg elements. The longer the leg elements, the easier it is to pick up the club again.

Moreover, the support saddle may be constructed such that it is in the form of a clip (a belt clip for example).

In accordance with the invention, provision is especially made for the resonant frequency of the fork part to be a fundamental note, for example 136 Hz or a multiple thereof. The resonant frequency of the fork part may also correspond to concert pitch "a" (440 Hz). The divot tool is thereby in the form of a divot tuning fork having a defined tuning frequency.

The following description of preferred embodiments in conjunction with the drawing will serve for a more detailed explanation of the invention.

DETAILED DESCRIPTION OF THE INVENTION

Figure 1:
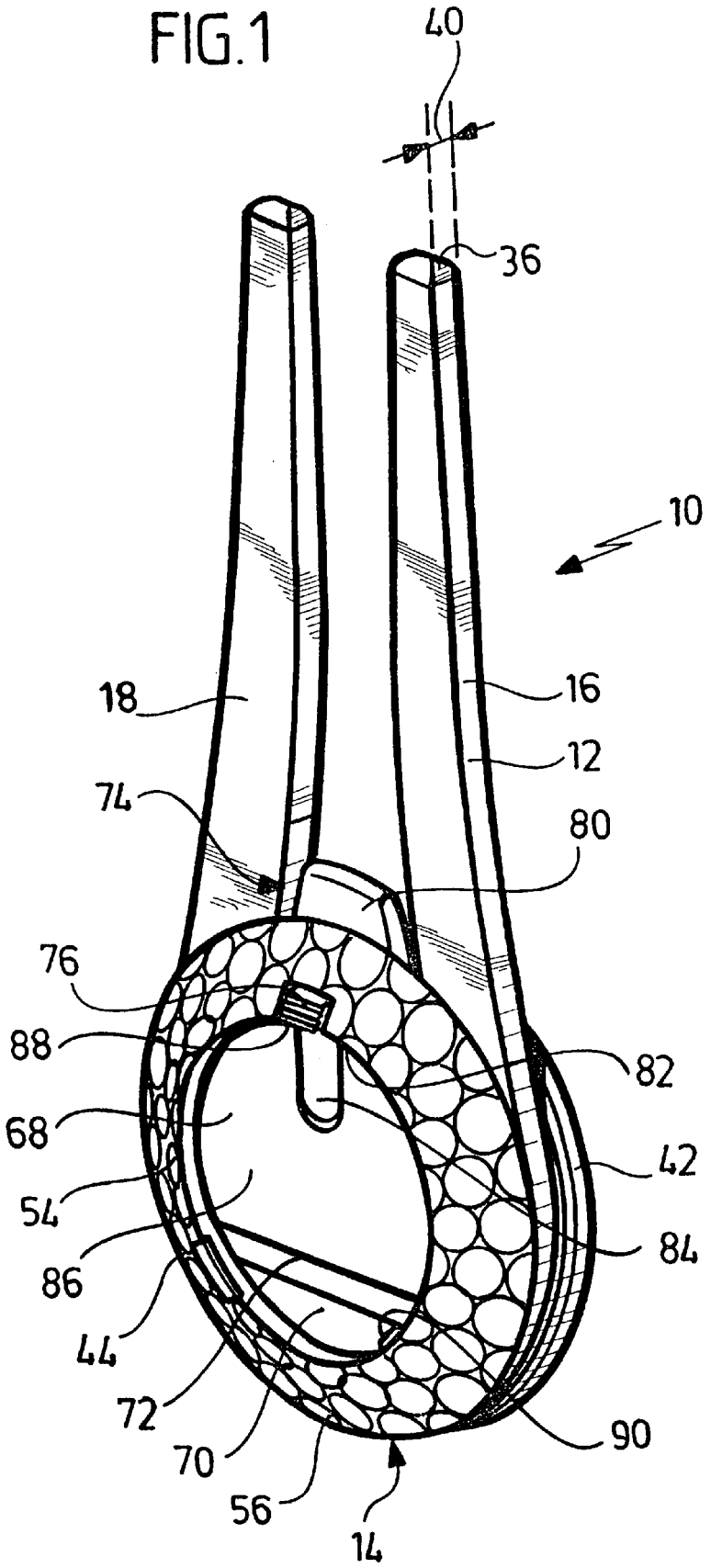
FIG. 1 shows a perspective view of a first embodiment of a divot tool in accordance with the invention.

An embodiment of a divot tool (pitch-repair fork) in accordance with the invention, which bears the general reference 10 in FIG. 1, comprises a fork part 12 and a handle part bearing the general reference 14. The fork part 12, which is in the form of a tuning fork, is held by the handle part 14.

Figure 2:
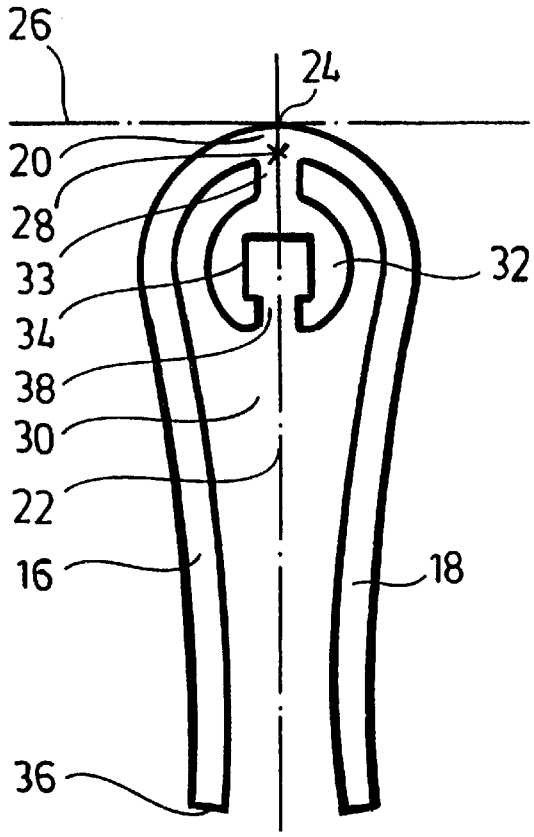
FIG. 2 a fork part of the divot tool according to FIG. 1.
Figure 3:
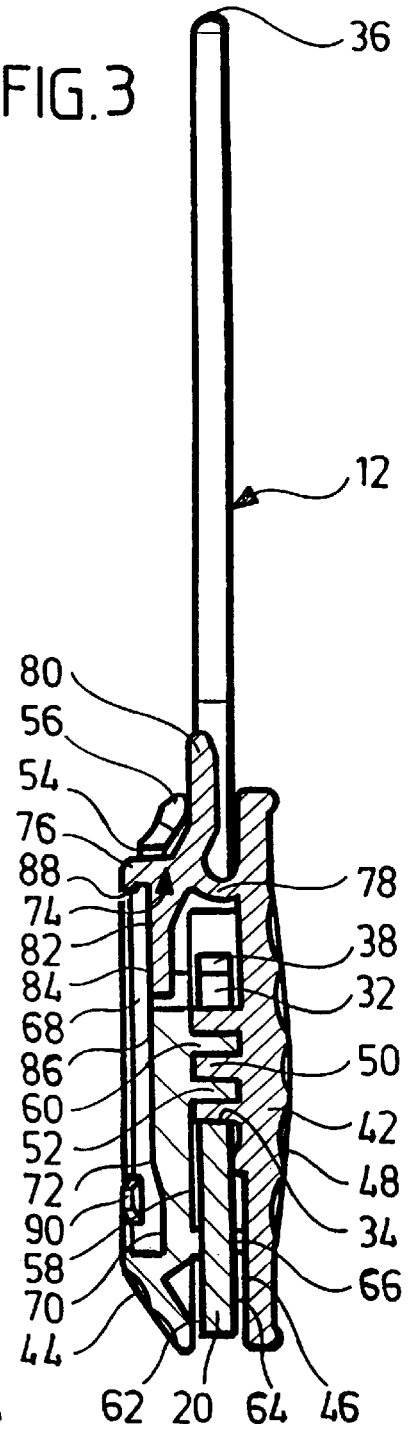
FIG. 3 a sectional side view of the divot tool according to FIG. 1.
Figure 4:
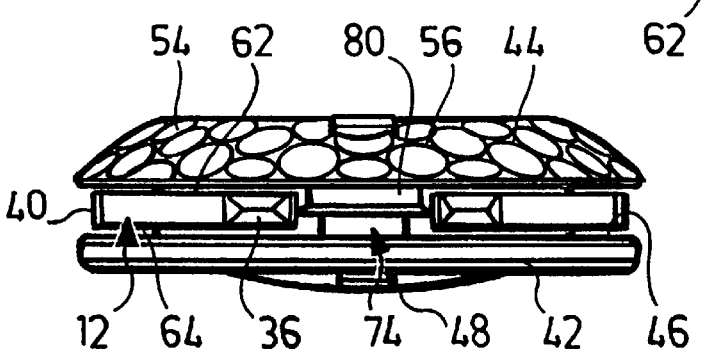
FIG. 4 a front view of the divot tool according to FIG. 1.

As is shown in FIG. 2, the handle part 14 is in one-piece form consisting of a first fork prong 16, a second fork prong 18 and a fork arch 20 whereby the fork arch 20 connects the two fork prongs 16 and 18 together. The fork part 12 is mirror symmetrical about a central plane 22 which is perpendicular to the plane of the drawing in FIG. 2.

The fork arch 20 comprises an outer vertex point 24 having a vertex tangent 26, and an inner vertex point 28. An attachment part 32 connected in one-piece form to the fork arch 20 is arranged on the inner vertex point 28 in an intermediary space 30 between the first fork prong 16 and the second fork prong 18. This attachment part 32 serves for fixing the fork part 12 to the handle part 14.

The attachment part 32 comprises an eye 34 serving to accommodate a corresponding meshing element on the handle part 14. For example, the eye 34 is in the form of a continuous rectangular opening in the attachment part 32, whereby this opening can be open at the ends 36 of the fork prongs 16, 18 and include an opening 38 whose width is less than the adjacent width of the eye 34, i.e. the eye 34 is in the form of a step at the opening 34. The contact surface between the handle part 14 and the attachment part 32 can thereby be minimized.

The attachment part 32 is connected via a bridge 33 to the fork arch 20.

In the first embodiment 10, a fork prong 16, 18 is formed such as to vibrate (FIGS. 1, 2). In the region of the fork arch 20, the outer dimensions of the first fork prong 16 and the second fork prong 18 are such as to form a circle so that a handle part 14 having a circular cross-section can cover the fork prongs 16, 18 in this region. The outer spacing between the first fork prong 16 and the second fork prong 18 is smaller in the vicinity of the end 36 than it is in the vicinity of the attachment part 32.

The fork prongs 16, 18 have a minimum width in the order of magnitude of 3 mm; an adequate width of the fork prongs 16, 18 is thereby obtained, this being expedient for the final processing of the fork prongs 16, 18, and also being necessary for setting a defined frequency of vibration for the fork part 12, in particular, for setting it to a fundamental note.

The depth 40 of the fork part 12 is substantially uniform over its entire length and, in particular, one outer surface of a fork part 12 is plane whilst the surface remote therefrom has an outer surface plane which is parallel to said first mentioned plane. Moreover, the normal vectors of said planes are, in particular, parallel to the direction of the depth 40 of the fork part 12.

The fork part 12 is made of a metal, for example, brass, whilst its size and shape are such that it will vibrate in the manner of a tuning fork at a defined, set and, in particular, pure frequency. In particular, the frequency of vibration is set such that the upper harmonics and lower harmonics are minimized, as is of course typical for a tuning fork. This frequency thereby represents a fundamental note. For example, provision is made for the tuning fork 12 to vibrate at a frequency of 136.1 Hz or multiples thereof. Concert pitch "a" (440 HZ) could also be set for example. The precision of the frequency setting should thereby be kept precisely to a frequency which is at least in the order of magnitude of 5 to 10 Hz, and especially, to at least 1 Hz.

The respective ends 36 of the fork prongs 16, 18 are preferably rounded or chamfered so that they are able to penetrate into the ground when it is being employed as a divot tool.

In the first embodiment 10 of a divot tool in accordance with the invention, the handle part 14 is in two sections, having a first handle element 42 and a second handle element 44 each of which has a substantially circular cross-section, the fork part 12 being arranged therebetween in vibratory manner.

The first handle element 42 comprises a substantially plane inner surface 46 and, for example, a domed outer surface 48. The shape of the outer surface 48 is not coupled to the functioning of the divot tool in accordance with the invention as a divot tuning fork, so that it is possible for the outer surface 48 to have a multiplicity of shapes. For example, the outer surface 48 may be designed such that it is similar in shape to the shaping of the outer surface of a golf ball.

A plurality of bar-like or tooth-like engaging elements 50, which are aligned in parallel to the tangent 26 to the vertex, are located over the length of the inner surface 46 of the first handle element 42 in the vicinity of the center of the first handle element 42. The engaging elements 50 are thereby uniformly spaced, having an intermediary space 52 therebetween. The length of the engaging elements 50 is adapted to the corresponding dimension of the eye 34 whereat the first handle element 42 is held in the eye 34 by means of a clamping force. Furthermore, one length of the plurality of engaging elements 50 is matched to the corresponding dimension of the eye 34 (perpendicular to the first mentioned dimension) so as to ensure the efficacy of this clamped mounting arrangement.

The second handle element 44 is also generally planar having an outer surface 54 whose shape is rather less dependent on technical requirements than on its aesthetic appeal. For example, the outer surface 54 may be provided with a bevelled face 56 which comprises depressions reminiscent of a golf ball. The two handle elements 42 and 44 could also be appropriately colored, white for example, so as to evoke an even greater impression of a golf ball.

A synthetic material in particular may be selected as the material for the two handle elements 42 and 44. One exemplary material is wood cement. By virtue of such materials, apart from the high degree of variability in regards to the shape, and also due to the very low mass of the handle part 14 which is achievable thereby, a high level of vibratory decoupling between the handle part 14 and the fork part 12 can be obtained, so that the vibrations of the divot tool 10 will occur at the frequency of the tuning fork 12 but the handle part 14 will not substantially affect this frequency, i.e. will not change it.

Bar-like engaging elements are also located on the inner surface 58 of the second handle element 44, these elements being aligned in parallel with the tangent 26 to the vertex and their dimensions along this direction being matched to those of the eye 34. The engaging elements 60 serve for engaging in the intermediary spaces 52 between the engaging elements 50 on the first handle element 42 in order to connect the two handle elements 42 and 44 together and, at the same time, to hold the fork part 12, which is in the form of a tuning fork, between the first handle element 42 and the second handle element 44.

The fork part 12 is thereby held substantially freely between the handle elements 42 and 44, namely there is an intermediary space 62 between the second handle element 44 and the fork part 12 and, correspondingly, an intermediary space 64 between the first handle element 42 and the fork part 12. Decoupling in a vibratory sense between the fork part 12 and the handle part 14 is thereby catered for so as to minimize, in particular, any damping effect of the handle part 14 on the vibration mode that has been excited in the fork part 12.

For the purposes of fixing the fork part 12 between the handle elements 42, 44 and, in particular, to ensure the formation of the intermediary spaces 62, 64, provision may be made for the fork part 12 to be adhered between the handle elements 42 and 44 in such a manner that the damping effect is minimized. For example adhesive layers 66 are provided, whereby the adhesive material is selected such that the effect upon the vibration of the fork part 12 is minimal.

In other respects, the depths of the engaging elements 50 and 60 should also be selected in such a manner that intermediary spaces 62 and 64 will be formed between the tuning fork 12 and the handle elements 42 and 44.

A recessed insert area 68, which may have a circular cross section in particular, is formed in the outer surface 54 of the second handle element 44. This insert area 68 serves for accommodating a marker which may be especially in the form of a disk. This marker may be an advertising plaque upon which the logo and/or the name of a golf course could be imprinted or embossed for example. Alternatively or simultaneously, it may also be a ball marker which can be utilized for marking the position of a golf ball. For example, the marker would then be provided with a pin projecting therefrom for sticking it into the ground. Accordingly, the insert area 68 would then be provided with an opening for this pin (not shown in the drawing).

The insert area 68 comprises a depression 70 which is disposed at one edge of the insert area 68, and, in particular, at a region of the insert area 68 remote from the ends of the fork prongs 16, 18. A tilting line 72 is formed by the depression 70. If a marker has been inserted into the insert area 68, then it will not be in surface contact with the insert area in the region of the depression 70. Should pressure then be applied to the marker in this region, it will then be tilted about the tilting line 72 and can be removed from the insert area 62 in a simple manner.

A snap action connector 74, by means of which the marker can be held in a clamped manner in the insert area, is provided in the embodiment shown in FIGS. 1 to 4. The snap action connector 74 comprises a resilient retaining element 76 for example, which is biased in such a manner as to exert a force in a direction towards the center of the insert area 68 on a marker located in the insert area 64. The retaining element itself is connected in movable, and in particular, tiltable manner to the first handle element 42 by a web element 78 which is seated, in particular, in one-piece manner on the inner surface 46 of the first handle element 42.

Furthermore, the retaining element is connected to a lever element 80 by means of which the retaining element 76 can be tilted when an appropriate force is exerted. The lever element 80 is thereby arranged between the two fork prongs 16 and 18 and projects out over their outer surfaces 48, 54 so that it is adapted to be actuated externally.

An opening 82, through which the retaining element 76 is introduced into the insert area 68, is arranged in the inner surface 58 of the second handle element 44.

Provision may also been made for a tongue 84 to be arranged on the retaining element 76 in the vicinity of the opening 72, said tongue being aligned substantially parallel to a seating surface 86 of the insert area 68 and being located below the seating surface 46 when the lever element 80 is in a state where force is not being applied, or, said tongue being flush therewith.

Provision may also be made for the upper edge of the retaining element to comprise a nose 88 for enabling a marker to be gripped at least partially from above so as to ensure better retention thereof in the insert area 68.

Likewise retaining noses 90 facing the insert area 68 may be formed on the face 56 for ensuring proper retention of the marker in the insert area 68.

Due to the bias of the retaining element 76, the latter exercises a force on a marker in the insert area 68. If the lever 80 is pressed in the direction of the first handle element 42, then the retaining element 76 will be tilted backwardly and hence the clamping effect will be canceled. At the same time, the tongue 84 is tilted upwardly and lifts an inserted marker, that is to say, it tilts it. The marker can then be removed from the insert area 68. Contrariwise, when inserting a marker, the marker is pressed into the insert area 68 and the retaining element 76 of the snap action connector 74 snaps-in when the marker is held on the deposition surface 68 in a retention position in which the marker is clamped.

The divot tool in accordance with the invention can be employed wherever a divot tool would be employed:

Displaced clumps of grass (divots) can be replaced with the divot tool 10. Golf shoes can be cleaned with the fork part 12 and the grooves in a golf club can also be cleaned therewith.

Markers, which carry the logo of a golf course and/or which are usable as ball markers, can be inserted into the insert area 68.

Moreover, the divot tool is also a tuning fork which vibrates at a defined frequency. Due, in particular, to the free mounting of the fork part 12 on the handle part 14, the frequency of vibration is not affected by the type of marker which is inserted into the insert area since the frequency of vibration is determined only by the fork part 12 and not by the total mass of the tool 10.

Figure 5:
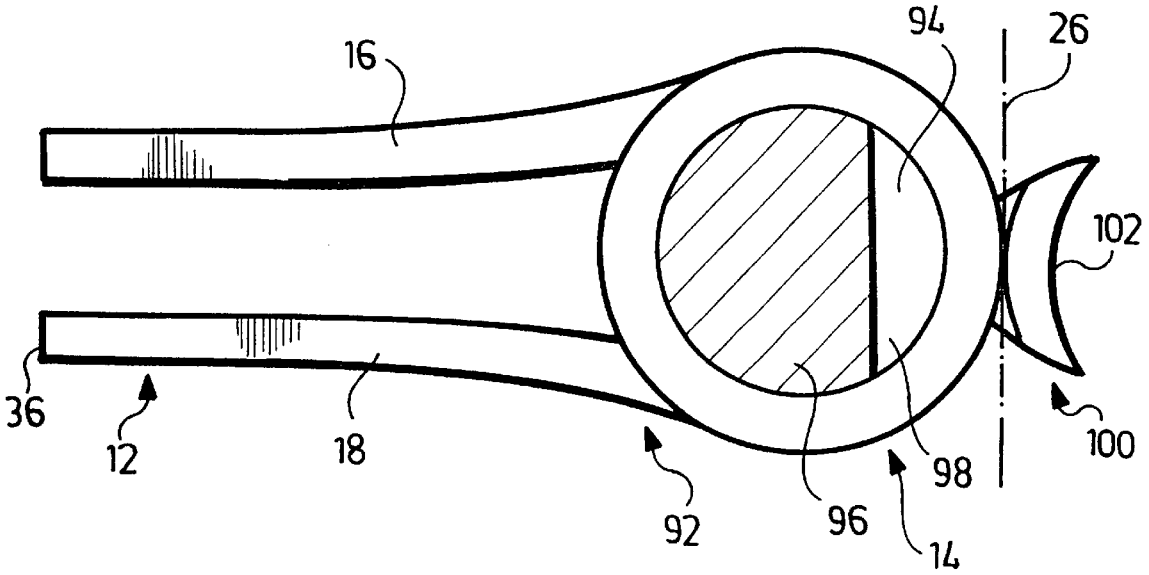
FIG. 5 a top view of a second embodiment of a divot tool in accordance with the invention.

A second embodiment of a divot tool bearing the general reference 92 in FIG. 5 is basically of the same construction as the first embodiment 10. Consequently, like components are referenced by the same reference symbols. In the second embodiment 92, the handle part 14 comprises an insert area 94 in which there is arranged a disk-shaped flat magnet 96, whereby here, a depression 98 is provided which, in particular, is formed such that no magnet is seated in the region of the depression 98. By virtue of the magnet 96, markers of magnetisable material can be held in the insert area 94. A marker in the insert area 94 can be tilted over the depression 98 in order to allow it to be removed from the insert area.

A support saddle 100, which has a saddle shaped seating surface 102, is seated on the handle part 14 in the vicinity of the tangent to the vertex, this support saddle being decoupled from the fork part 12 in a vibratory sense.

If the divot tool 92 is stuck into the turf by means of the fork part 12, then the grip of a golf club can be rested on the support saddle 100 for example so as to ensure that the grip of the golf club will remain dry should the grass be wet. Moreover, the golf club can be lifted more easily since the grip is located at a greater height. Hereby, one or more leg elements may be provided so as to increase the spacing between the seating surface 102 and the ends 36 of the fork prongs 16, 18 (not shown in the drawing).

In a corresponding embodiment, the support saddle 100 may also be employed as an implement for cleaning the grooves in a club for example.

Provision may also be made, for example, for the seating surface 102 of the support saddle 100 to be shaped such that e.g. cigarettes can be placed thereupon, that is to say, such that they do not come into contact with the ground.

Moreover, the support saddle 100 may also be in the form of a clip so as to enable the divot tool to be hung on the reverse for example.

Figure 6:
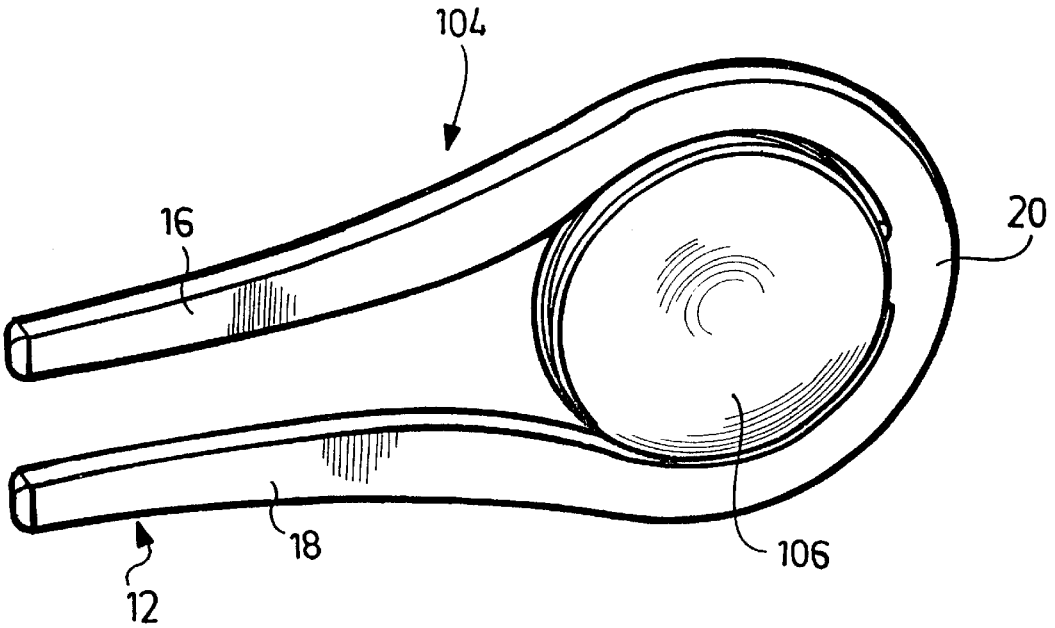
FIG. 6 a perspective view of a third embodiment of a divot tool.

A third embodiment of a divot tool in accordance with the invention bearing the general reference 104 in FIG. 6 is basically of the same construction as described hereinabove. One difference vis a vis the two embodiments 10 and 92 is that a handle part 106 is arranged between the fork prongs 16 and 18, that is to say, it does not cover them. Otherwise the divot tuning fork 104 functions in exactly the same manner as described above.

Figure 7:
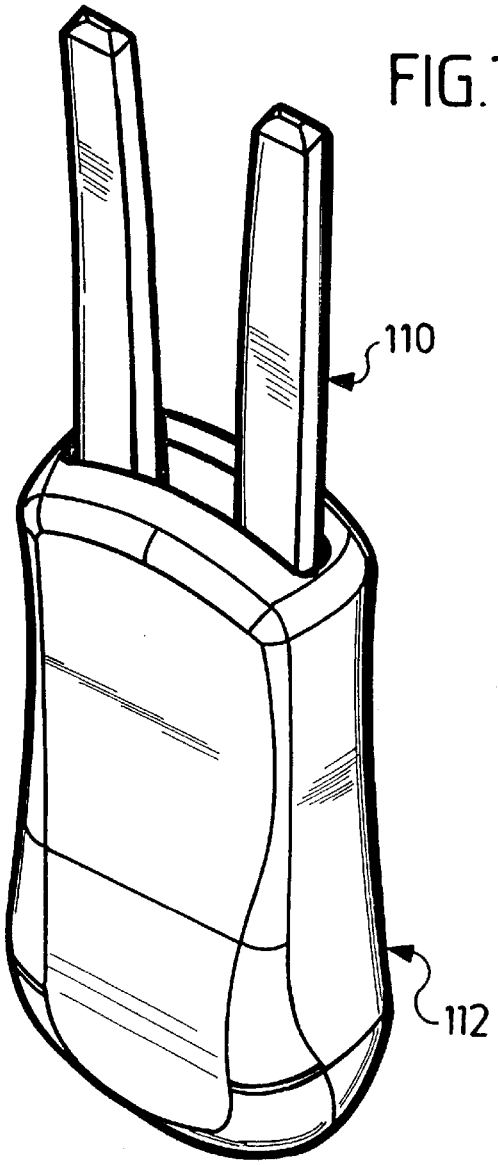
FIG. 7 a fourth embodiment of a divot tool.
Figure 8:
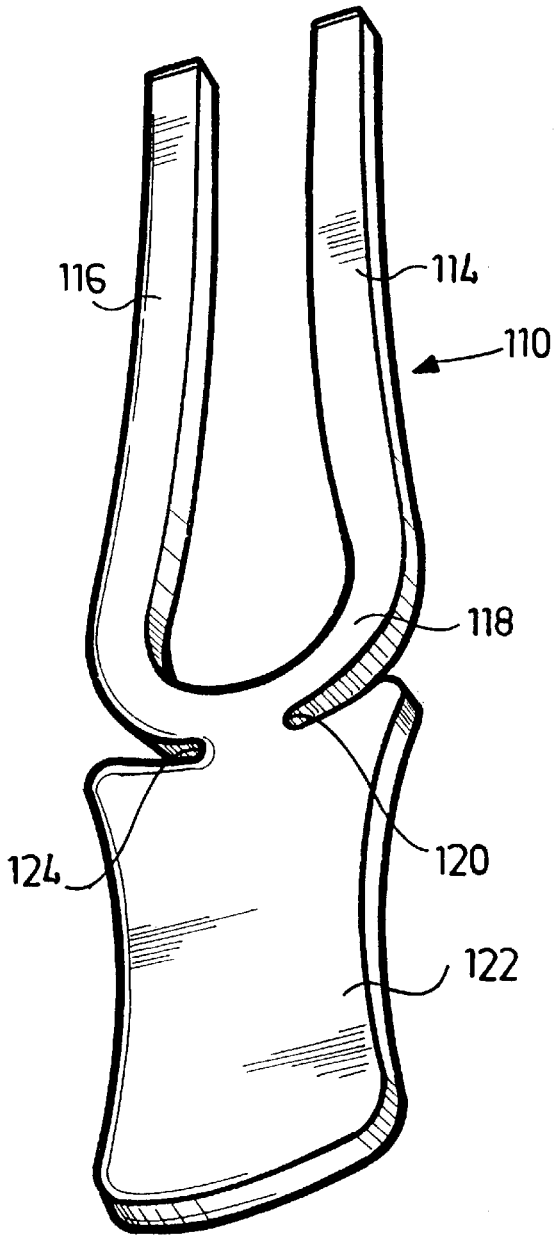
FIG. 8 a fork part of the divot tool according to FIG. 7.

In a fourth embodiment, shown in FIG. 7, there is again provided a fork part 110 in the form of a tuning fork which is held on a handle part 112 in the form of a sleeve. Hereby, the fork part 110 again comprises a first fork prong 114, a second fork prong 116 and a fork arch 118 which connects the two fork prongs. A mounting tab 122, which is connected via a bridge 124 to the fork arch 118, is connected in one-piece manner to the fork part 110 at a vertex 120 of the fork arch 118 and is located outside an intermediary space between the two fork prongs 114 and 116. The frequency of vibration of the fork part 110 including the mounting tab 122 is set to a defined fundamental note.

The fork part 110 is held in the sleeve-shaped handle part 112 by means of this mounting tab 122, namely in a free manner such that the frequency of vibration of the fork part

110 is basically unaffected. Otherwise, the divot tuning fork 108 functions in the manner described above.

What is claimed is:

1. A divot tool comprising a handle part and a fork part wherein the fork part is a tuning fork which vibrates at a defined frequency, and the construction of the handle part and the arrangement of the fork part on the handle part are such that the handle part does not substantially affect the frequency of vibration of the fork part.

2. A divot tool in accordance with claim 1, wherein the fork part is in one-piece form.

3. A divot tool in accordance with claim 1, wherein the fork part is made from a metallic material.

4. A divot tool in accordance with claim 1, wherein the handle part is made from a non-metallic material.

5. A divot tool in accordance with claim 1, wherein the fork part comprises a first fork prong and a second fork prong which are connected by means of a fork arch.

6. A divot tool in accordance with claim 1, wherein the fork part comprises opposite flat surfaces.

7. A divot tool in accordance with claim 5, wherein the width of a fork prong amounts to at least three millimeters.

8. A divot tool in accordance with claim 1, wherein an attachment part for the handle part is arranged on the fork part.

9. A divot tool in accordance with claim 8, wherein the attachment part extends away from an inner vertex point of a fork arch of the fork part.

10. A divot tool in accordance with claim 8, wherein the attachment part is arranged between the fork prongs of the fork part.

11. A divot tool in accordance with claim 8, wherein the attachment part is arranged outside an intermediary space between the fork prongs of the fork part.

12. A divot tool in accordance with claim 8, wherein the handle part is clamped on the attachment part.

13. A divot tool in accordance with claim 8, wherein the attachment part comprises an accommodation section for one or more engaging elements which are arranged on the handle part.

14. A divot tool in accordance with claim 13, wherein said engaging element of the handle part is a bar-like member.

15. A divot tool in accordance with claim 14, wherein said bar-like engaging element is arranged substantially parallel to a tangent to the vertex of the fork part.

16. A divot tool in accordance with claim 1, wherein, in regard to the fork prongs, the fork part is held freely on the handle part.

17. A divot tool in accordance with claim 16, wherein an adhesive layer is provided between the fork part and the handle part.

18. A divot tool in accordance with claim 1, wherein the handle part is constructed in two portions, having a first handle element and a second handle element between which the fork part is arranged.

19. A divot tool in accordance with claim 18, wherein the first handle element comprises a plurality of engaging elements arranged apart from each other.

20. A divot tool in accordance with claim 19, wherein the second handle element comprises one or more engaging elements which are adapted to be positioned in the intermediary space between the engaging elements of the first handle element.

21. A divot tool in accordance with claim 1, wherein the handle part comprises a recessed insert area for a marker.

22. A divot tool in accordance with claim 21, wherein the insert area comprises a depression which is constructed such that an inserted marker is tiltable against the depression in order to be removed.

23. A divot tool in accordance with claim 21, wherein the insert area is provided with a magnet for holding the marker magnetically.

24. A divot tool in accordance with claim 21, wherein the marker is held in the insert area by means of a clamping force.

25. A divot tool in accordance with claim 24, wherein the marker is manufactured from a non-magnetizable material.

26. A divot tool in accordance with claim 24, wherein a snap action connector is arranged on the handle part for holding the marker.

27. A divot tool in accordance with claim 1, wherein a support saddle is arranged on the handle part at the end thereof remote from the fork prongs.

28. A divot tool in accordance with claim 1, wherein the resonant frequency of the fork part is a fundamental note.

* * * * *